US008160289B2

(12) United States Patent
Park

(10) Patent No.: US 8,160,289 B2
(45) Date of Patent: Apr. 17, 2012

(54) SPEAKER WITH AUXILIARY AIR HOLE

(75) Inventor: Yong-Hyun Park, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 1480 days.

(21) Appl. No.: 11/699,205

(22) Filed: Jan. 29, 2007

(65) Prior Publication Data

US 2007/0195985 A1 Aug. 23, 2007

(30) Foreign Application Priority Data

Jan. 27, 2006 (KR) ..... 10-2006-0008938

(51) Int. Cl.
*H04R 25/00* (2006.01)

(52) U.S. Cl. ..... 381/386; 381/396; 381/388

(58) Field of Classification Search ..... 381/38–389, 381/395, 396–397
See application file for complete search history.

(56) References Cited

U.S. PATENT DOCUMENTS 5,862,242 A * 1/1999 Takewa et al. ..... 381/396
5,909,015 A * 6/1999 Yamamoto et al. ..... 381/397
6,243,479 B1 * 6/2001 Proni ..... 381/397
6,430,300 B1 * 8/2002 Cox et al. ..... 381/397
6,516,076 B1 * 2/2003 Marlin ..... 381/397
6,771,791 B2 * 8/2004 Shelley et al. ..... 381/397
6,804,366 B2 * 10/2004 Takahashi et al. ..... 381/397
7,110,536 B2 * 9/2006 Hampton et al. ..... 381/346
7,574,013 B2 * 8/2009 Funahashi et al. ..... 381/397

FOREIGN PATENT DOCUMENTS

KR 10-2005-0001018 1/2005
KR 10-2005-0017357 2/2005

* cited by examiner

*Primary Examiner* — Suhan Ni
(74) *Attorney, Agent, or Firm* — The Farrell Law Firm, P.C.

(57) ABSTRACT

A speaker applicable to various electronic devices includes a speaker body including a magnet and a diaphragm having a voice coil interacting with the magnet, the magnet and the diaphragm being sequentially received therein; at least one main hole defined through a rear surface of the speaker where a speaker sound is not output, such that air generated in the speaker according to vibration of the diaphragm is discharged therethrough; and at least one auxiliary air hole defined through a predetermined location of a side surface of the body to communicate with an inside of the body, such that air within the speaker is additionally discharged therethrough.

14 Claims, 3 Drawing Sheets

SPEAKER WITH AUXILIARY AIR HOLE

PRIORITY

This application claims priority under 35 U.S.C. §119 to an application filed in the Korean Intellectual Property Office on Jan. 27, 2006 and assigned Serial No. 2006-8938, the contents of which are incorporated herein by reference.

BACKGROUND OF THE INVENTION

1. Field of the Invention

The present invention relates generally to a speaker applicable to various electronic devices, and in particular, to a speaker with an auxiliary air hole, which is configured to ensure sufficient sound volume and quality by allowing smooth discharge of air generated in the speaker as a result of vibration of a diaphragm.

2. Description of the Related Art

In general, a speaker is operated by interaction between a magnet on a body having a circular receiving part, and a diaphragm provided with a voice coil installed at a predetermined distance from the magnet. When a drive signal is applied to the voice coil, the coil moves up or down according to a direction of a magnetic force line of the magnet, and the intensity and direction of an electromagnetic force line of the voice coil. At this time, the diaphragm vibrates together with the coil. The operation of the diaphragm is repetitively made and thus sound pressure is generated, so that the speaker outputs a sound within an audible frequency range.

In response to users' demands, small-sized electronic devices using the aforementioned speakers, such as a mobile terminal, an MP3 player, and the like, are becoming lower in volume and increasing their functionality. As for mobile terminals, a so-called 'slim phone' that has a slim profile resulting from minimizing the entire thickness of a device is being released, requiring the miniaturization of various components mounted in such a device.

When the aforementioned speaker is applied to such a device, a rear surface of the speaker, where no sound is output, is substantially attached to a case frame of the device.

However, the attachment between the rear surface of the speaker and the case frame of the device causes an inner surface of the case frame to block an air hole that is formed at the rear surface of the speaker and serves to discharge air generated by the vibration of the diaphragm. As a result, the air discharge is hindered, which results in a relative small sound volume and degradation in sound quality.

SUMMARY OF THE INVENTION

An object of the present invention is to substantially solve at least the above problems and/or disadvantages and to provide at least the advantages below. Accordingly, an object of the present invention is to provide a speaker with an auxiliary air hole, which is configured to allow smooth sound output and prevent degradation of sound quality while contributing to miniaturization of a device.

Another object of the present invention is to provide a speaker with an auxiliary air hole, which is configured to allow a sufficient amount of air to be discharged even when a space is not provided between a rear surface of the speaker and a case frame of a device.

According to an aspect of the present invention, a speaker includes: a speaker body including a magnet and a diaphragm having a voice coil interacting with the magnet, the magnet and the diaphragm being sequentially received therein; at least one main hole defined through a rear surface of the speaker where a speaker sound is not output, such that air generated in the speaker according to vibration of the diaphragm is discharged therethrough; and at least one auxiliary air hole defined through a predetermined location of a side surface of the body to communicate with an inside of the body, such that air within the speaker is additionally discharged therethrough.

BRIEF DESCRIPTION OF THE DRAWINGS

The above and other objects, features, and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described herein below with reference to the accompanying drawings. In the following description, well-known functions or constructions are not described in detail because they would obscure the present invention in unnecessary detail.

Although a slide type mobile terminal is illustrated and described herein, the present invention may also be applied to other devices having speakers besides a mobile terminal.

Figure 1:
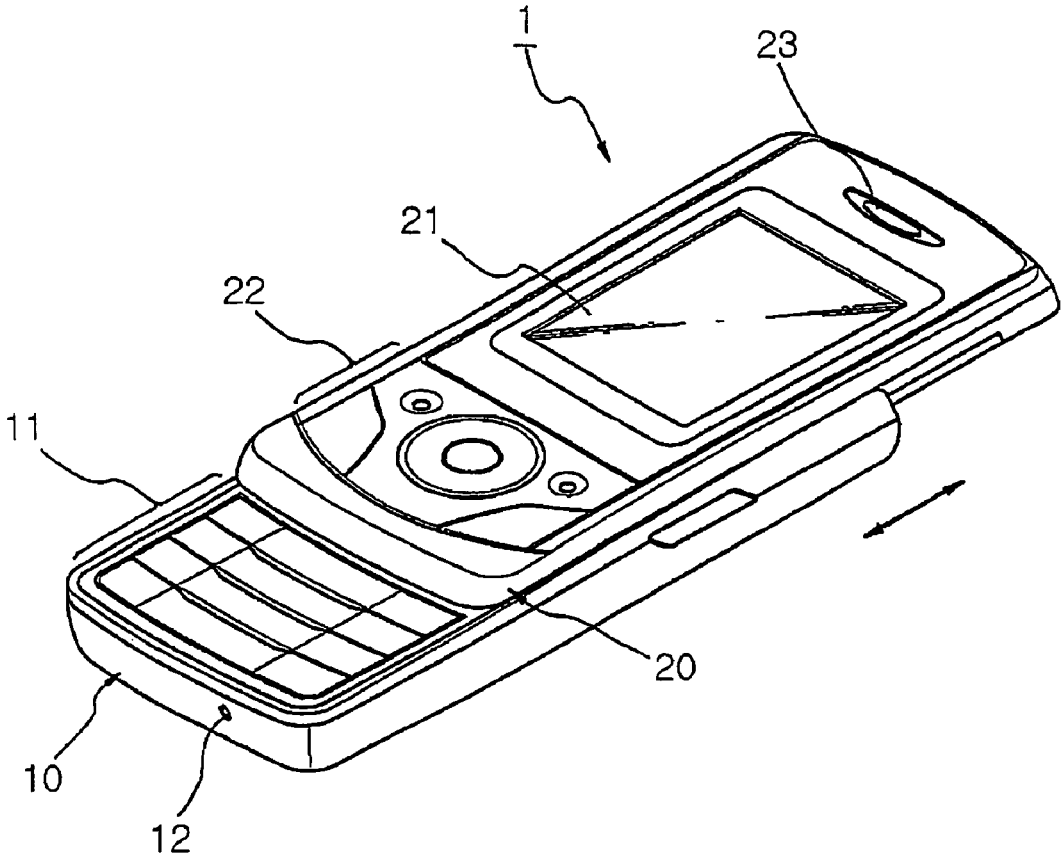
FIG. 1 is a perspective view of a mobile terminal with a speaker according to the present invention.

FIG. 1 is a perspective view of a slide type mobile terminal 1 having a speaker 23 according to the present invention.

Referring to FIG. 1, the terminal 1 includes a main body 10, and a slide body 20 configured to be opened/closed with respect to the main body 10 while sliding over a predetermined distance in a longitudinal direction of the terminal 1. A keypad assembly 11 serving as a data input unit having a plurality of key buttons is installed on a surface of the main body viewed when the slide body opens the main body 10. Also, a microphone unit 12 is installed under the keypad assembly 11 to transmit a voice of a user to another party during voice communication.

A display unit 21 is installed over a predetermined area of the slide body 20. A predetermined auxiliary keypad assembly 22 is installed under the display unit 21. The auxiliary keypad assembly 22 has key buttons used mostly when the slide body 20 closes the main body 10. A speaker 23 configured according to the present invention is installed above the display unit 21 to transmit a voice of another party to the user.

Figure 2:
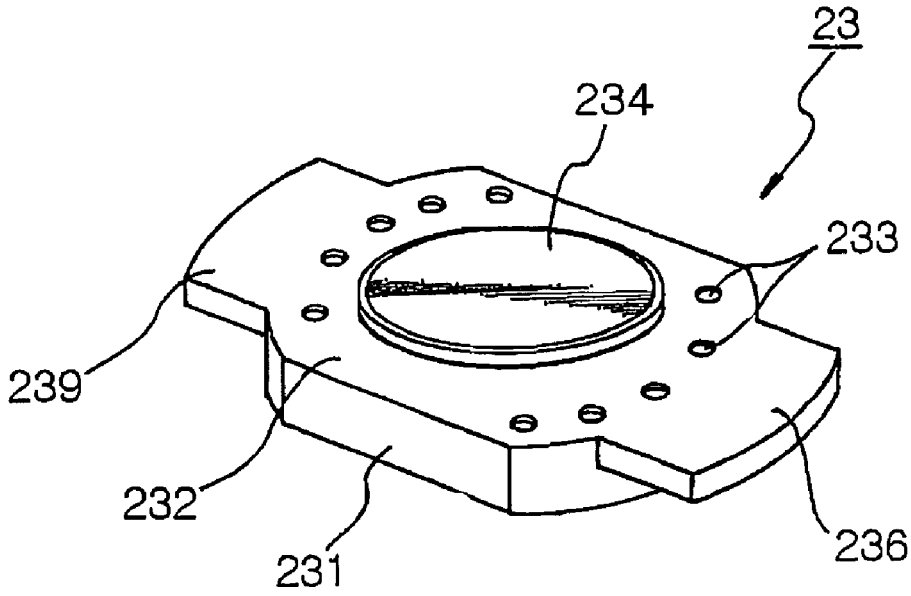
FIG. 2 is a rear perspective view of a speaker according to the present invention.
Figure 3:
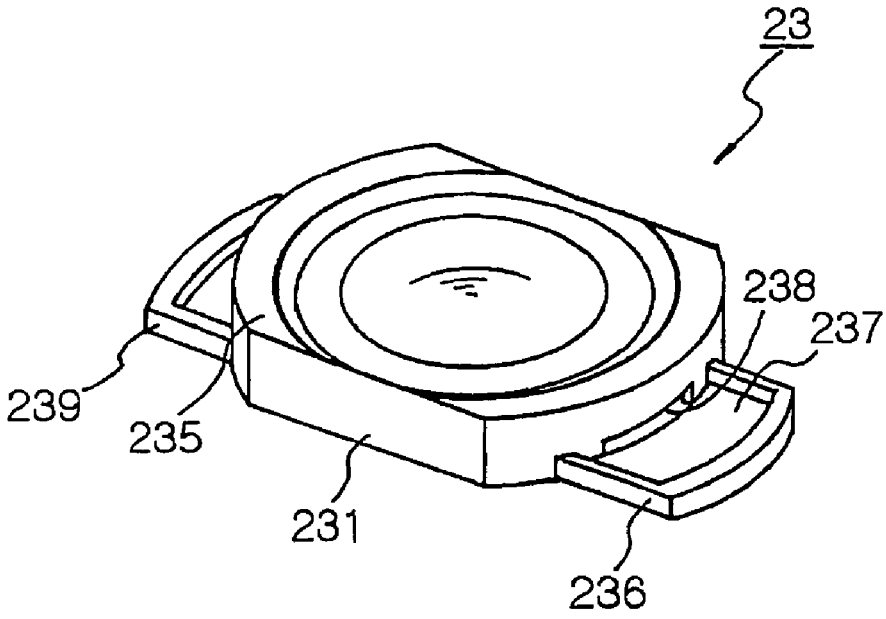
FIG. 3 is a front perspective view of the speaker shown in FIG. 2.

FIGS. 2 and 3 are rear and front perspective views, respectively, of the speaker 23 according to the present invention. In FIG. 2, an internal structure of the speaker 23 is not illustrated. The speaker 23 may include therein a well-known magnet 234, and a diaphragm including a predetermined voice coil operated at a predetermined distance from the magnet 234. Also, a voice coil is led out from the speaker 23 and receives an electrical signal.

The magnet and the diaphragm are sequentially received in a speaker body 231. Even though a part of the magnet 234 protrudes from a rear surface 232 of the speaker body 231 herein, the present invention is not limited thereto. For example, the part of the magnet 234 protruding outward from the rear surface 232 of the speaker body 231 serves to maintain a distance from a terminal case frame 25, shown in FIG. 4, to be discharged later. However, regardless of whether the magnet 234 protrudes from the rear surface 232, an inner surface 251 of the case frame 25, shown in FIG. 4, should be spaced from the rear surface 232 of the speaker 23 at a predetermined distance in a process of installing the speaker 23, in order to provide a minimum air discharge space 27, shown in FIG. 4, for main air-holes 233.

A plurality of main air holes 233 of predetermined shapes are defined through the rear surface 232 of the speaker body 231 at regular intervals. The main air holes 233 communicate with the inside of the speaker body 231 and allow the air generated by the vibration of the diaphragm to be discharged. In FIG. 2, a plurality of circular air holes 233 is arranged on the rear surface 232 of the speaker body 231 in a predetermined arc at regular intervals.

A pair of auxiliary air holes 238 is formed at side surfaces of the speaker body 231 to face each other. While the auxiliary air hole 238 is shown in the form of a long hole in FIG. 3, the auxiliary air hole 238 may be formed in the form of a plurality of circular holes if there is a sufficient space for the air discharge. Hereinafter, only one auxiliary air hole 238 and an air guide 236 corresponding thereto will be described for the purpose of the simplicity of description. Thus, a reference numeral 239 indicates another air guide that has the same shape and function as an air guide 236 to be described later.

A plate type air guide 236 of a predetermined length extends from the speaker body 231 around the auxiliary air hole 238. Preferably, the air guide 236 is formed integrally with the speaker body 231 at the time of molding the speaker body 231. The air guide 236 serves to guide air discharged from the auxiliary air hole 238 to a sufficiently large space within a device. That is, the air guide 236 guides air discharged from the auxiliary air hole 238 in a different direction from a direction in which the air is discharged from the main air holes 233, thereby enabling a sufficient amount of air to be discharged.

The air guide 236 preferably has a recess 237. A flange higher than the recess 237 can be formed around the recess 237. Preferably, the flange may be formed toward a sufficiently large space in the device to which air discharged from the auxiliary air hole 238 is guided.

Figure 4:
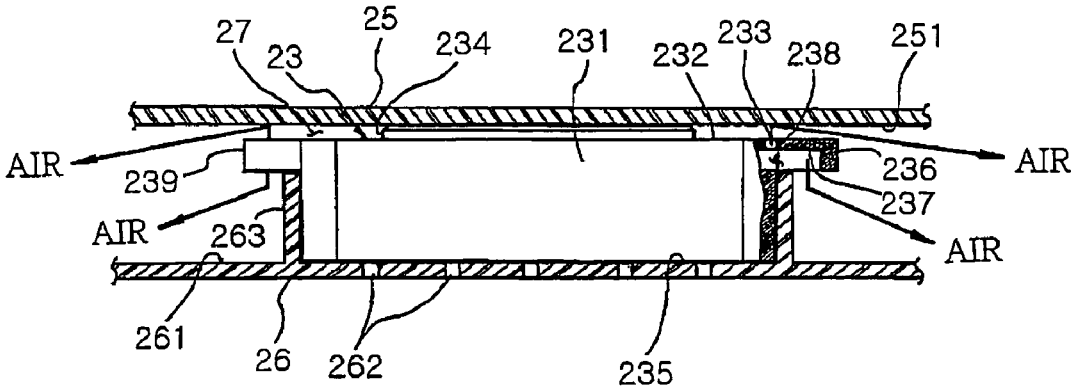
FIG. 4 is a sectional view of the speaker shown in FIG. 2 when it is installed on a case frame of a device.

FIG. 4 is a partial sectional view of a speaker 23 installed in case frames 25 and 26 of a device. The speaker 23 can be fixed within the slide body 20, shown in FIG. 1, including the upper case frame 26 and the lower case frame 25.

As illustrated in FIG. 4, an upper surface of the speaker body 231 is closely attached to an inner surface 261 of the case frame 26. Preferably, the body 231 of the speaker 23 is received in a bushing 263 protruding upward from the inner surface 261 of the upper case frame 26. Also, a rear surface 232 of the speaker body 231 is installed with a predetermined gap or space 27 from an inner surface 251 of the lower case frame 25. The space 27 is formed naturally by a height of the magnet 234 protruding from the rear surface 232 of the speaker body 231. However, even if the magnet 234 does not protrude from the rear surface 232, a sufficient predetermined-sized space 27 should be provided. The space 27 is for ensuring the flow of air discharged from the main air holes 233 formed on the rear surface 232 of the speaker 231.

An air discharge path of the speaker 23 formed in the aforementioned manner and installed in the terminal case frames 25 and 26 will now be described. The air generated in the speaker 23 according to the vibration of the diaphragm is discharged through the main air holes 233 of the speaker 231. The discharged air is provided to a sufficiently large space within the device along the space between the rear surface 232 of the speaker body 231 and the inner surface of the lower case frame 25.

At the same time, air is also discharged through the auxiliary air holes 238 formed at side surfaces of the speaker body 231. The air is guided along a recess surrounded by a flange of the air guide 237 and thus is discharged in a predetermined direction (i.e., in a downward direction in FIG. 4). The auxiliary air hole 238 serves to make the air discharge smooth even when the space 27 between the main air holes 233 and the lower case frame 25 is small.

A speaker according to the present invention includes a separate auxiliary air hole at its side surface in addition to an existing main hole facing a case frame to discharge the air. Thus, a sufficient amount of air can be discharged without being hindered, and therefore, a smooth sound output and high quality sound can be achieved.

While the present invention has been shown and described with reference to certain preferred embodiments thereof, it will be understood by those skilled in the art that various changes in form and details may be made therein without departing from the spirit and scope of the present invention as defined by the appended claims.

What is claimed is:

1. A speaker comprising:

a speaker body including a magnet and a diaphragm having a voice coil interacting with the magnet, the magnet and the diaphragm being sequentially received therein;

a plurality of main holes defined through a rear surface of the speaker body where speaker sound is not output, such that air flow generated in the speaker according to a vibration of the diaphragm is discharged therethrough; and at least one auxiliary air hole defined within a predetermined location of a side surface of the speaker body to communicate with an inside of the speaker body, such that air within the speaker is additionally discharged therethrough, wherein the speaker body includes a plate type air guide protruding from the speaker body around the at least one auxiliary air hole, the plate type air guide guiding air discharged from the at least one auxiliary air hole.

2. The speaker of claim 1, wherein the air guide includes a recess to form a flange along an edge thereof, the flange being formed toward the space to which air discharged from the auxiliary air hole is guided.

3. The speaker of claim 1, wherein the auxiliary air holes are defined through two sides of the speaker body facing each other.

4. The speaker of claim 3, wherein the at least one auxiliary air hole is formed as one long hole shape and the plurality of main holes are circular holes arranged at regular intervals.

5. The speaker of claim 1, wherein the at least one auxiliary air hole is formed as one long hole shape and the plurality of main holes are circular holes arranged at regular intervals.

6. A portable terminal comprising a speaker, the speaker comprising:

a speaker body for outputting sounds in response to received signals;

a plurality of main holes defined through a rear surface of the speaker body; and at least one first air hole defined at a side surface of the speaker body to communicate with an inside of the speaker body, such that air within the speaker is discharged therethrough, wherein the speaker body includes a plate type air guide protruding from the speaker body around the at least one first air hole, the plate type air guide guiding air discharged from the at least one first air hole.

7. The portable terminal of claim 6, the speaker further comprising the plurality of main holes defined through a rear surface of the speaker body, such that air generated in the speaker according to a vibration of the diaphragm is discharged therethrough.

8. The portable terminal of claim 6, wherein the air guide includes a recess to form a flange along an edge thereof, the flange being formed toward the space to which air discharged from the first air hole is guided.

9. The portable terminal of claim 6, wherein the first air holes are defined through two sides of the speaker body facing each other.

10. The portable terminal of claim 9, wherein the at least one first air hole is formed as one long hole shape and the plurality of main holes are circular holes arranged at regular intervals.

11. The portable terminal of claim 6, wherein the at least one first air hole is formed as one long hole shape and the plurality of main holes are circular holes arranged at regular intervals.

12. A speaker comprising:

a speaker body for outputting sounds in response to received signals;

a plurality of main holes defined through a rear surface of the speaker body; and at least one first air hole defined at a side surface of the speaker body to communicate with an inside of the speaker body, such that air within the speaker is discharged therethrough, wherein the speaker body includes a plate type air guide protruding from the speaker body around the at least one first air hole, the plate type air guide guiding air discharged from the at least one first air hole.

13. The speaker of claim 12, the speaker further comprising the plurality of main holes defined through a rear surface of the speaker body, such that air generated in the speaker according to a vibration of the diaphragm is discharged therethrough.

14. The speaker of claim 12, wherein the first air holes are defined through two sides of the speaker body facing each other.

* * * * *